US011597227B2

(12) United States Patent
Tanaka

(10) Patent No.: US 11,597,227 B2
(45) Date of Patent: Mar. 7, 2023

(54) RECORDING MEDIUM

(71) Applicant: CANON KABUSHIKI KAISHA, Tokyo (JP)

(72) Inventor: Takatoshi Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/352,479

(22) Filed: Jun. 21, 2021

(65) Prior Publication Data

US 2021/0394544 A1 Dec. 23, 2021

(30) Foreign Application Priority Data

Jun. 23, 2020 (JP) ..... JP2020-107609
Jun. 10, 2021 (JP) ..... JP2021-097001

(51) Int. Cl.
*B41M 5/50* (2006.01)
*B41M 5/52* (2006.01)

(52) U.S. Cl.
CPC ..... *B41M 5/502* (2013.01); *B41M 5/5218* (2013.01)

(58) Field of Classification Search
CPC ..... B41M 5/502; B41M 5/5218
USPC ..... 428/32.34
See application file for complete search history.

(56) References Cited

U.S. PATENT DOCUMENTS 8,080,291 B2 12/2011 Tanaka et al.
8,236,394 B2 8/2012 Tanaka et al.
8,247,042 B2 8/2012 Asakawa et al.
8,247,043 B2 8/2012 Tanaka et al.
8,545,008 B2 10/2013 Asao et al.
9,944,107 B2 4/2018 Tanaka et al.
2011/0300315 A1* 12/2011 Asakawa ..... B41M 5/00 428/32.2
2011/0300316 A1* 12/2011 Tanaka ..... B41M 5/00 428/32.31
2014/0004281 A1* 1/2014 Araki ..... B41M 5/506 428/32.31
2017/0197450 A1* 7/2017 Tanaka ..... B41M 5/502
2018/0074434 A1* 3/2018 Nito ..... B41M 5/506
2021/0394544 A1* 12/2021 Tanaka ..... B41M 5/502

FOREIGN PATENT DOCUMENTS

JP 2001287440 A 10/2001

* cited by examiner

*Primary Examiner* — Betelhem Shewareged
(74) *Attorney, Agent, or Firm* — Venable LLP

(57) ABSTRACT

The recording medium includes: an absorbent substrate; and an ink receiving layer provided on the absorbent substrate. The dry coating amount of the ink receiving layer is 6.0 g/m$^2$ or more to 11.0 g/m$^2$ or less, arithmetic average roughness Ra1 (μm) of a surface of the absorbent substrate satisfies a relationship of Expression (1) below, arithmetic average roughness Ra1 and arithmetic average roughness Ra2 (μm) of a surface of the ink receiving layer satisfy a relationship of Expression (2) below, and an average length RSm1 (mm) of a roughness curve element of the surface of the absorbent substrate and an average length RSm2 (mm) of a roughness curve element of the surface of the ink receiving layer satisfy a relationship of Expression (3) below.

$$Ra1 \geq 5.0\ \mu m \quad (1)$$

$$Ra2/Ra1 \geq 0.87 \quad (2)$$

$$RSm2/RSm1 \leq 1.40 \quad (3)$$

8 Claims, No Drawings

RECORDING MEDIUM

BACKGROUND OF THE INVENTION

Field of the Invention

The present invention relates to a recording medium.

Description of the Related Art

As recording media used in an ink jet recording method and the like, there are recording media with reduced glossiness and with calm and deep matte tones. As a method of obtaining such recording media with reduced glossiness and with matte tones, a method using an inorganic particle with large secondary particle diameters is known. In recent years, recording media with irregular surfaces, representative examples of which include art papers, have been required from among recording media with matte tones. Such recording media require irregular surfaces of base materials to be reflected to surfaces on which images are to be recorded (letter printing portions, printing portions), require no irregularities due to the unevenness to be caused in images, and require images with high optical concentration and excellent color development to be able to be recorded.

As a recording medium with a matte tone that is suitable for recording painting-like or calligraphy-like images, a recording medium for ink jet with an ink receiving layer with surface roughness, centerline average roughness, and Oken smoothness controlled within specific numerical ranges, for example, has been proposed (Japanese Patent Application Laid-Open No. 2001-287440).

SUMMARY OF THE INVENTION

The present invention is intended to provide a recording medium, which maintains feeling of unevenness of a base material at a solid printing portion and reduces irregularities, on which images with high optical concentration can be recorded, even in a case in which water-based dye ink is used.

According to an aspect of the present invention, provided is a recording medium including: an absorbent substrate; and an ink receiving layer provided on the absorbent substrate and containing an inorganic particle and a binder, in which a dry coating amount of the ink receiving layer is 6.0 g/m$^2$ or more to 11.0 g/m$^2$ or less, arithmetic average roughness Ra1 (μm) of a surface of the absorbent substrate defined by ISO 4287:1997 satisfies a relationship of Expression (1) below, the arithmetic average roughness Ra1 and arithmetic average roughness Ra2 (μm) of a surface of the ink receiving layer defined by ISO 4287:1997 satisfy a relationship of Expression (2) below, and an average length RSm1 (mm) of a roughness curve element of the surface of the absorbent substrate defined by ISO 4287:1997 and an average length RSm2 (mm) of a roughness curve element of the surface of the ink receiving layer defined by ISO 4287:1997 satisfy a relationship of Expression (3) below.

$$Ra1 \geq 5.0\ \mu m \quad (1)$$

$$Ra2/Ra1 \geq 0.87 \quad (2)$$

$$RSm2/RSm1 \leq 1.40 \quad (3)$$

Further features of the present invention will become apparent from the following description of exemplary embodiments.

DESCRIPTION OF THE EMBODIMENTS

It was found to be possible to record images with optical concentration in a certain level when the images are recorded on the recording medium proposed in Japanese Patent Application Laid-Open No. 2001-287440 using water-based pigment ink. However, it was found to be difficult to record images with optical concentration in a high level required in recent years in a case in which water-based dye ink is used.

The present inventors thus carried out intensive studies to provide a recording medium, which maintains feeling of unevenness of a base material at a solid printing portion and reduces irregularities, on which an image with high optical concentration can be recorded, even in a case in which water-based dye ink is used, and contrived the present invention.

<Recording Medium>

Hereinafter, the present invention will be described in more detail with reference to exemplary embodiments. Hereinafter, a recording medium for ink jet will also simply be referred to as a "recording medium". The present inventors carried out intensive studies to provide a recording medium, which maintains feeling of unevenness of a base material at a solid printing portion and reduces irregularities, on which images with high optical concentration can be recorded, even in a case in which water-based dye ink is used. As a result, the present inventors found that the following configuration can achieve the aforementioned object and completed the present invention. In other words, the recording medium according to the present invention is a recording medium that includes an absorbent substrate and an ink receiving layer provided on the absorbent substrate and containing an inorganic particle and a binder and that is suitable for ink jet. Arithmetic average roughness Ra1 (μm) of a surface of the absorbent substrate measured in accordance with ISO 4287:1997 satisfies a relationship of Expression (1) below.

$$Ra1 \geq 5.0\ \mu m \quad (1)$$

By setting the arithmetic average roughness Ra1 of the surface of the absorbent substrate to be 5.0 μm or more, a recording medium with a rough surface feeling with distinct unevenness can be obtained even if the ink receiving layer is provided on the absorbent substrate. If the arithmetic average roughness Ra1 of the surface of the absorbent substrate is less than 5.0 μm, distinct unevenness does not appear on the surface of the ink receiving layer provided on the absorbent substrate, and a recording medium with rough surface feeling cannot be obtained. The upper limit of the arithmetic average roughness Ra1 of the surface of the absorbent substrate is not particularly limited, and the upper limit may be 10.0 μm or less, for example.

The aforementioned arithmetic average roughness Ra1 and an arithmetic average roughness Ra2 (μm) of the surface of the ink receiving layer defined by ISO 4287:1997 satisfy a relationship of Expression (2) below.

$$Ra2/Ra1 \geq 0.87 \quad (2)$$

The ink receiving layer is usually disposed on the absorbent substrate by drying a coating layer formed by coating the absorbent substrate with a coating liquid for the ink receiving layer. Although the arithmetic average roughness Ra2 of the surface of the ink receiving layer is affected by a size level of the absorbent substrate; concentration, viscosity and a coating amount of the coating liquid; drying conditions of the coating layer; and the like, the arithmetic average roughness Ra2 of the surface of the ink receiving layer is controlled within a range that is approximated to the arithmetic average roughness Ra1 of the surface of the absorbent substrate to some extent. If the value of "Ra2/Ra1" is 0.87 or more, the surface unevenness of the absorbent substrate substantially follows the surface unevenness of the ink receiving layer, and substantially no difference in thickness occurs within the ink receiving layer. Therefore, even if an ink is applied to the ink receiving layer of the recording medium, substantially no concentration difference occurs within the ink receiving layer, and a uniform image with no irregularities can be recorded.

If the value of "Ra2/Ra1" is less than 0.87, the surface unevenness of the ink receiving layer does not sufficiently follow the surface unevenness of the absorbent substrate. Therefore, the ink receiving layer at locations corresponding to projecting portions of the absorbent substrate is thin while the ink receiving layer at locations corresponding to recessed portions of the absorbent substrate is thick. Thus, if ink is applied to the ink receiving layer of such a recording medium, concentration irregularities occur within the ink receiving layer, and it is not possible to record a uniform image with no irregularities. The arithmetic average roughness Ra1 of the surface of the absorbent substrate and the arithmetic average roughness Ra2 of the surface of the ink receiving layer may satisfy a relationship of Expression (6) below. This enables recording of more uniform images with further reduced irregularities.

$$0.91 \leq Ra2/Ra1 \leq 1.05 \quad (6)$$

Although the arithmetic average roughness Ra2 of the surface of the ink receiving layer is not particularly limited as long as the arithmetic average roughness Ra2 satisfies the aforementioned relationship of Expression (2), the arithmetic average roughness Ra2 may be 4.4 μm or more to 10.5 μm or less. Note that in a case in which two or more ink receiving layers are included, the arithmetic average roughness Ra2 of the surface of the ink receiving layer in the present invention means arithmetic average roughness of the ink receiving layer that is a frontmost layer that is present at the furthest position from the base material.

An average length RSm1 (mm) of a roughness curve element of the surface of the absorbent substrate defined by ISO 4287:1997 and an average length RSm2 (mm) of a roughness curve element of the surface of the ink receiving layer defined by ISO 4287:1997 satisfy a relationship of Expression (3) below.

$$RSm2/RSm1 \leq 1.40 \quad (3)$$

Although the average length RSm2 of the roughness curve element of the ink receiving layer is affected by a size level of the absorbent substrate; the concentration, the viscosity and the coating amount of the coating liquid; drying conditions of the coating layer; and the like, the average length RSm2 of the roughness curve element of the ink receiving layer is controlled within a range that is approximated to the average length RSm1 of the roughness curve element of the surface of the absorbent substrate to some extent. If the value of "RSm2/RSm1" is 1.40 or less, the surface unevenness of the absorbent substrate substantially follows the surface unevenness of the ink receiving layer, and substantially no difference in thickness occurs within the ink receiving layer. Therefore, even if an ink is applied to the ink receiving layer of the recording medium, substantially no concentration difference occurs within the ink receiving layer, and a uniform image with no irregularities can be recorded.

If the value of "RSm2/RSm1" exceeds 1.40, mismatching occurs between the cycle of the surface unevenness of the ink receiving layer and the cycle of the surface unevenness of the absorbent substrate, and a difference in thickness within the ink receiving layer becomes excessively large. Thus, if ink is applied to the ink receiving layer of such a recording medium, concentration irregularities occur within the ink receiving layer, and it is not possible to record a uniform image with no irregularities. The average length RSm1 of the roughness curve element of the surface of the absorbent substrate and average length RSm2 of the roughness curve element of the surface of the ink receiving layer may satisfy a relationship of Expression (7) below. This enables recording of more uniform images with further reduced irregularities.

$$0.95 \leq RSm2/RSm1 \leq 1.30 \quad (7)$$

Although the average length RSm1 of the roughness curve element of the surface of the absorbent substrate is not particularly limited as long as the average length RSm1 satisfies the aforementioned relationship of Expression (3), the average length RSm1 may be 0.20 mm or more to 0.60 mm or less, for example. Also, although the average length RSm2 of the roughness curve element of the surface of the ink receiving layer is not particularly limited as long as the average length RSm2 satisfies the aforementioned relationship of Expression (3), the average length RSm2 may be 0.28 mm or more to 0.78 mm or less, for example.

The dry coating amount of the ink receiving layer is 6.0 $g/m^2$ or more to 11.0 $g/m^2$ or less and may be 7.0 $g/m^2$ or more to 10.0 $g/m^2$ or less. By setting the dry coating amount of the ink receiving layer within the aforementioned range, it is possible to obtain a recording medium, which maintains feeling of unevenness of the base material at a solid printing portion and reduces irregularities, on which images with high optical concentration can be recorded. If the dry coating amount is less than 6.0 $g/m^2$, it is difficult to sufficiently cover the surface of the absorbent substrate with large unevenness. Therefore, a covering portion and an uncovering portion are present together on the absorbent substrate, and irregularities occur in a recorded image. On the other hand, if the dry coating amount exceeds 11.0 $g/m^2$, the absorbent substrate is excessively covered. Therefore, unevenness of the surface of the absorbent substrate does not appear clearly, and it is difficult to obtain feeling of unevenness of the base material. Also, since the ink receiving layer becomes excessively thick, it is not possible to raise optical concentration of images recorded with water-based dye ink.

(Absorbent Substrate)

The "absorbent substrate" in the specification means a base material with a Cobb water absorption degree of 5.0 $g/m^2$ or more after 30 seconds measured in accordance with ISO 535:1991. Any base material can be used as long as the base material satisfies the aforementioned Cobb water absorption degree. Examples of the absorbent substrate include cast coated paper, baryta paper, non-sized paper with appropriate sizing, coated paper, and cotton paper. Among these, cotton paper may be used as the absorbent substrate in terms of a texture. It is possible to obtain a recording medium that exhibits sufficient absorbency even if the amount of coating liquid (coating amount) used to form the ink receiving layer is small and to provide the ink receiving layer without losing feeling of surface unevenness of the absorbent substrate, by using the absorbent substrate.

(Ink Receiving Layer)

The ink receiving layer provided on the absorbent substrate contains an inorganic particle and a binder. The ink receiving layer can typically be disposed on the absorbent substrate by drying the coating layer formed by coating the absorbent substrate with a coating liquid containing the materials included in the ink receiving layer. In other words, the materials included in the ink receiving layer are substantially the same as the materials included in the coating liquid for the ink receiving layer.

A value of a ratio (P/B ratio) of content P of the inorganic particle with respect to content B of the binder in the ink receiving layer may be 100/30 or more to 100/70 or less. By setting the value of the P/B ratio within the aforementioned range, it is possible to apply sufficient strength to the ink receiving layer and to enhance color development of images and ink absorbency.

The ink receiving layer may be provided as a single layer, or two or more ink receiving layers may be provided. However, in a case in which two or more ink receiving layers are provided, two or more coating liquids may be applied at the same time. In a case in which the ink receiving layers are successively provided, the coating liquid for the second ink receiving layer is applied to the first ink receiving layer. Since absorption•drying conditions of the coating liquids significantly vary in this case, it may be slightly difficult to form the ink receiving layers with desired feeling of unevenness.

[Inorganic Particle]

The average secondary particle diameter of the inorganic particle may be 3.0 μm or more. It is possible to form the ink receiving layer with more enhanced matte-tone surface quality by using the inorganic particle with the average secondary particle diameter of 3.0 μm or more. Note that although an upper limit of the average secondary particle diameter of the inorganic particle is not particularly limited, the upper limit may be 15.0 μm or less, for example. As used herein, the "average secondary particle diameter" of the inorganic particle or the like means a volume-based cumulative 50% particle diameter (D50) measured by a laser diffraction method.

As the inorganic particle, a white pigment such as silica, alumina, or light calcium carbonate can be used. Among these, amorphous silica may be used. The amorphous silica may be manufactured by any manufacturing method. Examples of the method for producing amorphous silica include a dry method and a wet method. The dry method is roughly classified into a burning method and a heating method. On the other hand, the wet method is roughly classified into a precipitation method and a gelation method.

The burning method out of the dry method is a method that is also called a gas phase method and a method of manufacturing amorphous silica by burning a mixture of gasified silicon tetrachloride and hydrogen in air at 1,500 to 2,000° C.

The precipitation method out of the wet method is a method of obtaining amorphous silica as a precipitate by causing silicate soda, a sulfuric acid, and the like in an aqueous solution. According to the precipitation method, it is possible to adjust a primary particle diameter and the like of obtained amorphous silica by controlling conditions such as a reaction temperature and an acid addition speed. Further, according to the precipitation method, it is also possible to adjust a secondary particle diameter and the like of obtained amorphous silica by controlling drying conditions, pulverization conditions and the like.

The gelation method out of the wet method is a method of obtaining amorphous silica by adding silicate soda and a sulfuric acid at the same time. According to the gelation method, it is possible to obtain amorphous silica with a three-dimensional hydrogel structure in which polymerization between silica particles due to dehydration condensation of a silanol group has been advanced. Since amorphous silica manufactured by the gelation method has a relatively small hydrogel structure, the specific surface area thereof is larger than that of amorphous silica manufactured by the precipitation method. Among these, amorphous silica manufactured by the gelation method may be used.

The inorganic particle may include first amorphous silica and second amorphous silica. The first amorphous silica and the second amorphous silica have different average secondary particle diameter. Also, the arithmetic average roughness Ra1 (μun) of the surface of the absorbent substrate and an average secondary particle diameter D1 (μm) of the first amorphous silica may satisfy a relationship of Expression (4) below. Further, the arithmetic average roughness Ra1 (μm) of the surface of the absorbent substrate and an average secondary particle diameter D2 (μun) of the second amorphous silica may satisfy a relationship of Expression (5) below. By satisfying the relationships of Expressions (4) and (5) below, it is possible to further enhance color development of images recorded with water-based dye ink. Note that a mixture ratio (mass ratio) between the first amorphous silica and the second amorphous silica may satisfy the content of the first amorphous silica:the content of the second amorphous silica=30:70 to 70:30.

$$D1 \leq Ra1 \quad (4)$$

$$D2 \geq Ra1 \quad (5)$$

The oil absorption amount of the amorphous silica measured in accordance with JIS K6217-4:2017 may be 150 mL/100 g or more to 350 mL/100 g or less and may further be 180 mL/100 g or more to 330 mL/100 g or less. The pore volume of the amorphous silica obtained by the BET method may be 1.0 mL/g or more and may further be 1.3 mL/g or more. Also, the specific surface area of the amorphous silica obtained by the BET method may be 200 $m^2/g$ or more to 500 $m^2/g$ or less.

[Binder]

Examples of the binder include polyvinyl alcohol (PVA), oxidized starch, etherified starch, phosphoric acid esterified starch, carboxymethyl cellulose, hydroxyethyl cellulose, casein, gelatin, soybean protein, polyvinylpyrrolidone, a maleic anhydride resin, a styrene-butadiene copolymer, a conjugate polymer latex such as a methyl methacrylate-butadiene copolymer, acrylic polymer latex such as a polymer of acrylic acid ester and methacrylic acid ester, vinyl polymer latex such as an ethylene-vinyl acetate copolymer, a melamine resin, a urea resin, a (co) polymer resin of acrylic acid ester such as polymethyl methacrylate and methacrylic acid ester, a polyurethane resin, an unsaturated polyester resin, a vinyl chloride-vinyl acetate copolymer, polyvinyl butyral and an alkyd resin.

One of the above binders can be used alone, or two or more of the binders can be used in combination. Among these, polyvinyl alcohol (PVA) may be used as a binder. The average degree of polymerization of PVA may be 1,500 or more to 5,000 or less. The degree of saponification of PVA may be 70% or more to 100% or less. It is also possible to use modified PVA such as silanol-modified PVA having a silanol group at its terminal as a binder.

[Additives]

The ink receiving layer and the coating liquid of the ink receiving layer can appropriately contain additives such as a pigment dispersant, a fastness improver and a surfactant. In particular, a cationic polymer may be contained in the coating liquid for the ink receiving layer since it is possible to enhance dispersibility of the coating liquid and to enhance fastness and water proofness of recorded images. Examples of the cationic polymer include a polymer having a primary to tertiary amino group in its molecule and a polymer having a quaternary ammonium base. Examples of the cationic polymer include polyalkylene polyamines, derivatives of polyalkylene polyamines, a dicyan-based cation resin, a polyamine-based cation resin, an epichlorohydrin-dimethylamine addition polymer, a dimethyldialylammonium chloride polymer and a diallylamine salt polymer.

The content of the additives in the ink receiving layer and the coating liquid for the ink receiving layer may be 0.1 parts by mass or more to 30.0 parts by mass or less with respect to 100 parts by mass of inorganic particle such as amorphous silica.

(Manufacturing Method of Recording Medium)

A method of manufacturing the aforementioned recording medium is not particularly limited. The recording medium may be manufactured by a manufacturing method including a process (coating liquid preparation process) of preparing the coating liquid for the ink receiving layer and a process (coating process) of coating the absorbent substrate with the prepared coating liquid, for example.

In the coating liquid preparation step, the coating liquid for the ink receiving layer is prepared. The coating liquid can be prepared by mixing the aforementioned constituents by a usual method.

In the coating process, the coating layer is formed by coating the absorbent substrate with the prepared coating liquid. In order to apply the coating liquid to the absorbent substrate, it is possible to use a gate roll coater, a size press, a bar coater, a blade coater, an air knife coater, a roll coater, a brush coater, a curtain coater, a gravure coater, a spray device or the like. Note that the coating liquid appropriately warmed may be applied.

The coating layer formed by coating the absorbent substrate with the coating liquid may be dried. In order to dry the coating layer, a hot air dryer such as a linear tunnel dryer, an arch dryer, an air loop dryer or a sine curve air float dryer can be used. It is also possible to use an infrared dryer, a heating dryer, a dryer using microwaves or the like. The heating temperature at the time of the drying can be set to 80 to 130° C.

Before coating the absorbent substrate with the coating liquid, a surface treatment liquid containing a surface treatment liquid may be applied to the surface of the absorbent substrate (the surface to which the coating liquid is applied). By applying the surface treatment liquid to the surface of the absorbent substrate in advance, wettability of the coating liquid with respect to the absorbent substrate is enhanced, and adhesion between the formed ink receiving layer and the absorbent substrate can be improved. Examples of the surface treatment liquid include thermoplastic resins such as an acrylic resin, a polyurethane resin, a polyester resin, a polyethylene resin, a polyvinyl chloride resin, a polypropylene resin, a polyamide resin and a styrene-butadiene copolymer; a silane coupling agent; and the like. The surface treatment liquid may contain an inorganic particle such as titanium oxide, calcium carbide, silica, and alumina as needed.

<Image Recording Method>

It is possible to record images on the recording medium by causing a recording head of ink jet scheme to eject an ink and applying the ink to the recording medium. Examples of the method of ejecting ink include a method of ejecting ink by applying mechanical energy to the ink and a method of ejecting ink by applying thermal energy to the ink. As the ink, water-based ink containing a dye as a coloring material (water-based dye ink) or water-based ink containing a pigment as a coloring material (water-based pigment ink) can be used. Among these, the water-based dye ink may be used.

According to the present invention, it is possible to provide a recording medium, which maintains feeling of unevenness of the base material at the solid printing portion and reduces irregularities, on which images with high optical concentration can be recorded, even in a case in which water-based dye ink is used.

EXAMPLES

Although the present invention will be described below in more detail with reference to examples and comparative examples, the present invention is not limited by the following examples as long as it does not depart from the gist thereof. Constituent amounts described with "parts" and "%" are on the basis of mass unless particularly indicated otherwise.

<Manufacturing of Absorbent Substrate>

(Absorbent Substrates A, B and C)

Water was added to paper raw materials with the composition described below to adjust the mixture such that the solid concentration was 3.0%. Note that "CSF" is an abbreviation of Canadian Standard Freeness.

[Paper Raw Materials]

Cotton linter pulp with a degree of drainage of 330 mL CSF: 100 parts

Cationized starch: 0.6 parts

Heavy calcium carbonate: 10 parts

Light calcium carbonate: 15 parts

Alkylate ketene dimer: 0.2 parts

Cationic polyacrylamide: 0.05 parts

Next, a Fourdrinier paper machine was used to make a paper, three-stage wet press was performed, and then the paper was dried with a multi-cylinder dryer. A size press device was used to impregnate the paper with an aqueous solution of oxidized starch such that the solid content was 1.0 g/m$^2$ and was then dried. After that, an absorbent substrate A with a basis weight of 150 g/m$^2$, the arithmetic average roughness Ra1=6.6 (μm) defined by ISO 4287: 1997, and the average length RSm1=0.31 (mm) of a roughness curve element was obtained by performing machine calendar finishing thereon. The Cobb water absorption degree of the thus obtained absorbent substrate A after 30 seconds measured in accordance with ISO 535:1991 was 25 g/m$^2$.

Further, an absorbent substrate B with Ra1=5.1 (μm) and RSm1=0.29 (mm) and an absorbent substrate C with Ra1=4.4 (μm) and RSm1=0.25 (mm) were obtained by appropriately changing press conditions and calendar conditions. The Cobb water absorption degrees of the obtained absorbent substrate B and the absorbent substrate C were 23 g/m$^2$ and 22 g/m$^2$, respectively.

(Absorbent Substrate D)

Water was added to paper raw materials with the composition described below to adjust the mixture such that the solid concentration was 3.0%.

[Paper Raw Materials]

Broad-leaved tree bleached kraft pulp (LBKP) with a degree of drainage of 450 mLCSF: 80 parts Needle-leaved tree bleached kraft pulp (NBKP) with a degree of drainage of 480 mLCSF: 20 parts Cationized starch: 0.6 parts Heavy calcium carbonate: 10 parts Light calcium carbonate: 15 parts Alkylate ketene dimer: 0.1 parts Cationic polyacrylamide: 0.03 parts Next, a Fourdrinier paper machine was used to make a paper, three-stage wet press was performed, and then the paper was dried with a multi-cylinder dryer. A size press device was used to impregnate the paper with an aqueous solution of oxidized starch such that the solid content was 1.0 g/m$^2$ and was then dried. After that, an absorbent substrate D with a basis weight of 150 g/m$^2$, the arithmetic average roughness Ra1=6.6 (μun) measured in accordance with ISO 4287:1997, and the average length RSm1=0.31 (mm) of a roughness curve element was obtained by performing machine calendar finishing thereon. The Cobb water absorption degree of the thus obtained absorbent substrate D was 23 g/m$^2$.

<Manufacturing of Recording Medium>

(Preparation of Dispersions A and B)

A dispersant solution was obtained by adding 10 parts of a dispersant (trade name "Charol DC-902" manufactured by DKS Co., Ltd.) with respect to 100 parts of silica to pure water. A dispersion was obtained by adding amorphous silica A (trade name "Nipgel AY-603" manufactured by Tosoh Silica Corporation, D50: 10.0) μm) to the thus obtained dispersant solution such that solid content concentration of amorphous silica was 19% with the amount and sufficiently stirring the mixture with a stirrer. The obtained dispersion was appropriately diluted with pure water to obtain a dispersion A in which the solid concentration of amorphous silica powder was 18%.

Also, a dispersion B with a solid concentration of 18% was obtained similarly to the aforementioned dispersion A other than that amorphous silica B (trade name "Gasil 23F" manufactured by PQ Corporation, D50: 6.0 μm) was used instead of the amorphous silica A.

(Preparation of Coating Liquids A and B for Ink Receiving Layer)

Polyvinyl alcohol (trade name "PVA235" manufactured by Kuraray Co., Ltd.) was dissolved in ion-exchanged water to obtain a PVA aqueous solution with a solid content concentration of 8%. The dispersion A, the dispersion B, and the PVA aqueous solution were mixed such that a mass ratio of amorphous silica A:amorphous silica B:binder (PVA) was 50:50:40. Pure water was added thereto such that the total solid concentration was 13%, and the mixture was stirred, thereby obtaining a coating liquid A for an ink receiving layer.

Also, a coating liquid B for an ink receiving layer was obtained similarly to the aforementioned case of the coating liquid A other than that the dispersion A and the PVA aqueous solution were mixed such that a mass ratio of amorphous silica A:binder (PVA) was 100:40 (the dispersion B was not used).

(Recording Medium 1)

A coating layer was formed by coating the absorbent substrate A with the coating liquid A such that the dry coating amount was 10.0 g/m$^2$. An ink receiving layer was formed by drying the formed coating layer with hot airflow at 100° C., thereby obtaining a recording medium 1.

(Recording Medium 2)

A recording medium 2 was obtained similarly to the aforementioned case of the recording medium 1 other than that the coating liquid A was applied such that the dry coating amount was 11.0 g/m$^2$.

(Recording Medium 3)

A recording medium 3 was obtained similarly to the aforementioned case of the recording medium 1 other than that the coating liquid A was applied such that the dry coating amount was 10.5 g/m$^2$.

(Recording Medium 4)

A recording medium 4 was obtained similarly to the aforementioned case of the recording medium 1 other than that the coating liquid A was applied such that the dry coating amount was 7.0 g/m$^2$.

(Recording Medium 5)

A recording medium 5 was obtained similarly to the aforementioned case of the recording medium 1 other than that the coating liquid A was applied such that the dry coating amount was 8.0 g/m$^2$.

(Recording Medium 6)

A recording medium 6 was obtained similarly to the aforementioned case of the recording medium 1 other than that the coating liquid A was applied such that the dry coating amount was 9.0 g/m2 and an ink receiving layer was formed by drying the coating layer with hot airflow at 110° C.

(Recording Medium 7)

A recording medium 7 was obtained similarly to the aforementioned case of the recording medium 6 other than that the coating liquid A was applied such that the dry coating amount was 12.0 g/m$^2$.

(Recording Medium 8)

A recording medium 8 was obtained similarly to the aforementioned case of the recording medium 6 other than that the coating liquid A was applied such that the dry coating amount was 10.0 g/m$^2$.

(Recording Medium 9)

A recording medium 9 was obtained similarly to the aforementioned case of the recording medium 6 other than that the coating liquid A was applied such that the dry coating amount was 11.0 g/m$^2$.

(Recording Medium 10)

A recording medium 10 was obtained similarly to the aforementioned case of the recording medium 6 other than that an ink receiving layer was formed by drying the coating layer with hot airflow at 90° C.

(Recording Medium 11)

A recording medium 11 was obtained similarly to the aforementioned case of the recording medium 6 other than that an ink receiving layer was formed by drying the coating layer with hot airflow at 80° C.

(Recording Medium 12)

A recording medium 12 was obtained similarly to the aforementioned case of the recording medium 6 other than that an ink receiving layer was formed by drying the coating layer with hot airflow at 70° C.

(Recording Medium 13)

A recording medium 13 was obtained similarly to the aforementioned case of the recording medium 1 other than that the coating liquid A was applied such that the dry coating amount was 9.5 g/m$^2$.

(Recording Medium 14)

A recording medium 14 was obtained similarly to the aforementioned case of the recording medium 1 other than that the coating liquid B was used instead of the coating liquid A.

(Recording Medium 15)

A recording medium 15 was obtained similarly to the aforementioned case of the recording medium 1 other than that the absorbent substrate D was used instead of the absorbent substrate A.

(Recording Medium 16)

A recording medium 16 was obtained similarly to the aforementioned case of the recording medium 1 other than that the coating liquid A was applied such that the dry coating amount was 6.0 g/m$^2$.

(Recording Medium 17)

A recording medium 17 was obtained similarly to the aforementioned case of the recording medium 1 other than that the coating liquid A was applied such that the dry coating amount was 5.0 g/m$^2$.

(Recording Medium 18)

A recording medium 18 was obtained similarly to the aforementioned case of the recording medium 1 other than that the absorbent substrate C was used instead of the absorbent substrate A.

(Recording Medium 19)

A recording medium 19 was obtained similarly to the aforementioned case of the recording medium 1 other than that the absorbent substrate B was used instead of the absorbent substrate A.

Details of the obtained recording media are shown in Table 1.

TABLE 1

| | Recording medium | Base material | Ra1 (μm) | RSm1 (mm) | D1 (μm) | D2 (μm) | Coating amount (g/m$^2$) | Ra2 (μm) | RSm2 (mm) | Ra2/Ra1 | RSm2/RSm1 |
|---|---|---|---|---|---|---|---|---|---|---|---|
| Example 1 | 1 | A | 6.6 | 0.31 | 6.0 | 11.0 | 10.0 | 6.6 | 0.38 | 1.00 | 1.22 |
| Comparative Example 1 | 2 | A | 6.6 | 0.31 | 6.0 | 11.0 | 11.0 | 5.4 | 0.37 | 0.82 | 1.20 |
| Example 2 | 3 | A | 6.6 | 0.31 | 6.0 | 11.0 | 10.5 | 5.8 | 0.38 | 0.88 | 1.21 |
| Example 3 | 4 | A | 6.6 | 0.31 | 6.0 | 11.0 | 7.0 | 5.9 | 0.36 | 0.90 | 1.15 |
| Example 4 | 5 | A | 6.6 | 0.31 | 6.0 | 11.0 | 8.0 | 6.1 | 0.37 | 0.92 | 1.19 |
| Example 5 | 6 | A | 6.6 | 0.31 | 6.0 | 11.0 | 9.0 | 6.9 | 0.31 | 1.04 | 1.01 |
| Comparative Example 2 | 7 | A | 6.6 | 0.31 | 6.0 | 11.0 | 12.0 | 7.0 | 0.32 | 1.06 | 1.02 |
| Example 6 | 8 | A | 6.6 | 0.31 | 6.0 | 11.0 | 10.0 | 6.4 | 0.29 | 0.97 | 0.94 |
| Example 7 | 9 | A | 6.6 | 0.31 | 6.0 | 11.0 | 11.0 | 6.9 | 0.30 | 1.04 | 0.96 |
| Example 8 | 10 | A | 6.6 | 0.31 | 6.0 | 11.0 | 9.0 | 6.5 | 0.40 | 0.99 | 1.29 |
| Example 9 | 11 | A | 6.6 | 0.31 | 6.0 | 11.0 | 9.0 | 6.4 | 0.41 | 0.97 | 1.31 |
| Example 10 | 12 | A | 6.6 | 0.31 | 6.0 | 11.0 | 9.0 | 6.2 | 0.43 | 0.94 | 1.39 |
| Comparative Example 3 | 13 | A | 6.6 | 0.31 | 6.0 | 11.0 | 9.5 | 6.4 | 0.45 | 0.97 | 1.45 |
| Example 11 | 14 | A | 6.6 | 0.31 | — | 11.0 | 10.0 | 6.6 | 0.37 | 1.00 | 1.19 |
| Example 12 | 15 | D | 6.6 | 0.31 | 6.0 | 11.0 | 10.0 | 6.6 | 0.38 | 1.00 | 1.24 |
| Example 13 | 16 | A | 6.6 | 0.31 | 6.0 | 11.0 | 6.0 | 6.1 | 0.33 | 0.93 | 1.07 |
| Comparative Example 4 | 17 | A | 6.6 | 0.31 | 6.0 | 11.0 | 5.0 | 6.2 | 0.32 | 0.94 | 1.04 |
| Comparative Example 5 | 18 | C | 4.4 | 0.25 | 6.0 | 11.0 | 10.0 | 4.3 | 0.25 | 0.98 | 1.03 |
| Example 14 | 19 | B | 5.1 | 0.29 | 6.0 | 11.0 | 10.0 | 5.2 | 0.30 | 1.01 | 1.03 |

<Evaluation>

(Recording of Images)

Ink jet recording apparatus (trade name "PIXUS TS6030" manufactured by Canon) was used to record images (solid printing portions) of (R, G, B)=(0, 0, 0) on the recording media 1 to 19 in a "swelling paper" mode. As ink, a water-based dye ink (trade name "BCI-351" manufactured by Canon, black (Bk) ink), which was a genuine ink of the aforementioned ink jet recording apparatus, was used.

(Evaluation of Irregularities in Solid Printing Portion)

The recorded images (solid printing portions) were visually observed, and the irregularities at the solid printing portions were evaluated in accordance with evaluation criteria described below. The irregularities in the solid printing portions mean irregularities (non-uniformity) of printing concentration. Results are shown in Table 2. From among the evaluation criteria described below, "A", "B" and "C" were regarded as favorable levels, and "D" was regarded as an unacceptable level.

A: A level in which there were substantially no irregularities

B: A level in which irregularities were slightly observed

C: A level in which there were no problems in practical use although a small amount of irregularities were observed D: A level in which distinct irregularities were seen (Evaluation of Feeling of Unevenness at Solid Printing Portions)

The recorded images (solid printing portions) and white paper portions were visually observed, and feeling of unevenness at the solid printing portions was evaluated in accordance with evaluation criteria described below. Results are shown in Table 2. From among the evaluation criteria described below, "A" and "B" were regarded as favorable levels, and "C" was regarded as an unacceptable level.

A: A level in which there were substantially no differences in feeling of unevenness at the solid printing portions and the white paper portions B: A level in which there were no problems although feeling of unevenness at the solid printing portions was slightly degraded as compared with that at the white paper portions.

C: A level in which feeling of unevenness at the solid printing portions was significantly degraded as compared with that at the white paper portions.

(Evaluation of Dye Color Development)

After recording the images, the images were left for 2 days in an environment at 25° C. and 50% RH (relative humidity).

Thereafter, a spectrophotometer (trade name "Spectrolino" manufactured by Gretag Macbeth) was used to measure an O. D. value (optical concentration), and the dye color development was evaluated in accordance with evaluation criteria described below. Results are shown in Table 2. From among the evaluation criteria described below, "A" and "B" were regarded as favorable levels, and "C" was regarded as an unacceptable level.

A: The O.D. value was 1.60 or more.

B: The O. D. value was 1.50 or more to less than 1.60.

C: The O. D. value was less than 1.50.

TABLE 2

| | Recording medium | Irregularities at solid printing portion | Feeling of unevenness at solid printing portion | Dye color development |
|---|---|---|---|---|
| Example 1 | 1 | A | A | A |
| Comparative Example 1 | 2 | D | B | B |
| Example 2 | 3 | C | A | A |
| Example 3 | 4 | B | A | A |
| Example 4 | 5 | A | A | A |
| Example 5 | 6 | B | A | A |
| Comparative Example 2 | 7 | C | C | C |
| Example 6 | 8 | C | B | A |
| Example 7 | 9 | B | B | B |
| Example 8 | 10 | A | A | A |
| Example 9 | 11 | B | A | A |
| Example 10 | 12 | C | A | A |
| Comparative Example 3 | 13 | D | A | A |
| Example 11 | 14 | A | A | B |
| Example 12 | 15 | A | A | A |
| Example 13 | 16 | B | A | A |
| Comparative Example 4 | 17 | D | A | A |
| Comparative Example 5 | 18 | A | C | A |
| Example 14 | 19 | A | B | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-107609, filed Jun. 23, 2020, and Japanese Patent Application No. 2021-097001, filed Jun. 10, 2021, which are hereby incorporated by reference herein in their entirety.

What is claimed is:

1. A recording medium comprising:

an ab sorb ent substrate; and an ink receiving layer provided on the absorbent substrate and containing an inorganic particle and a binder, wherein a dry coating amount of the ink receiving layer is 6.0 g/m$^2$ or more to 11.0 g/m$^2$ or less, wherein an arithmetic average roughness Ra1 (μm) of a surface of the absorbent substrate defined by ISO 4287:1997 satisfies a relationship of Expression (1) below, wherein the arithmetic average roughness Ra1 and an arithmetic average roughness Ra2 (μm) of a surface of the ink receiving layer defined by ISO 4287:1997 satisfy a relationship of Expression (2) below, wherein an average length RSm1 (mm) of a roughness curve element of the surface of the absorbent substrate defined by ISO 4287:1997 and an average length RSm2 (mm) of a roughness curve element of the surface of the ink receiving layer defined by ISO 4287:1997 satisfy a relationship of Expression (3) below, and wherein the arithmetic average roughness Ra2 satisfies a relationship of Expression (8) below:

$$Ra1 \geq 5.0\ \mu m \quad (1);$$

$$Ra2/Ra1 \geq 0.87 \quad (2);$$

$$RSm2/RSm1 \leq 1.40 \quad (3); \text{ and}$$

$$4.4\ \mu m \leq Ra2 \leq 10.5\ \mu m \quad (8).$$

2. The recording medium according to claim 1, wherein the inorganic particle includes first amorphous silica and second amorphous silica, wherein the arithmetic average roughness Ra1 and an average secondary particle diameter D1 (μm) of the first amorphous silica satisfy a relationship of Expression (4) below, and wherein the arithmetic average roughness Ra1 and an average secondary particle diameter D2 (μm) of the secondary amorphous silica satisfy a relationship of Expression (5) below:

$$D1 \leq Ra1 \quad (4); \text{ and}$$

$$D2 \geq Ra1 \quad (5).$$

3. The recording medium according to claim 1, wherein the arithmetic average roughness Ra1 and the arithmetic average roughness Ra2 satisfy a relationship of Expression (6) below:

$$0.91 \leq Ra2/Ra1 \leq 1.05 \quad (6).$$

4. The recording medium according to claim 1, wherein the average length RSm1 of the roughness curve element and the average length RSm2 of the roughness curve element satisfy a relationship of Expression (7) below:

$$0.95 \leq RSm2/RSm1 \leq 1.30 \quad (7).$$

5. The recording medium according to claim 1, wherein the recording medium is used for ink jet.

6. The recording medium according to claim 1, wherein the arithmetic average roughness Ra1 satisfies a relationship of Expression (1') below:

$$Ra1 \geq 6.6\ \mu m \quad (1').$$

7. The recording medium according to claim 1, wherein a Cobb water absorption degree of the absorbent substrate is 5.0 g/m$^2$ or more after 30 seconds measured in accordance with ISO 535:1991.

8. The recording medium according to claim 1, wherein the absorbent substrate is cotton paper.

* * * * *